United States Patent [19]

Hanson

[11] 4,031,708

[45] June 28, 1977

[54] SLIPFORMING METHOD AND APPARATUS FOR IN SITU LINING OF AN UPWARDLY OPEN SHAFT WITH MONOLITHIC CONCRETE

[76] Inventor: Raymond A. Hanson, c/o R. A. Hanson Co., P.O. Box 7400, Spokane, Wash. 99207

[22] Filed: Sept. 20, 1976

[21] Appl. No.: 725,007

[52] U.S. Cl. ..... 61/41 R; 61/42; 61/84; 166/287; 264/32; 425/59

[51] Int. Cl.[2] ..... E21D 5/00

[58] Field of Search ..... 61/41 R, 35, 53.66, 61/53.64, 53.52, 42, 84, 85; 166/287; 52/742, 127; 264/31, 32; 425/59, 63, 213; 249/10

[56] References Cited

UNITED STATES PATENTS

| | | | |
|---|---|---|---|
| 158,865 | 1/1875 | Pontez | 166/287 |
| 233,826 | 10/1880 | Wilson | 425/59 |
| 1,313,013 | 8/1919 | Polysu | 249/10 X |
| 2,937,429 | 5/1960 | Livingston | 425/59 |
| 3,126,959 | 3/1964 | Ortloff | 166/287 |
| 3,131,768 | 5/1964 | Chancellar et al. | 61/41 R X |
| 3,193,901 | 7/1965 | Lee et al. | 264/31 X |
| 3,434,294 | 3/1969 | Hall | 61/53.64 X |
| 3,958,637 | 5/1976 | Cobbs | 166/287 |

FOREIGN PATENTS OR APPLICATIONS

| | | | |
|---|---|---|---|
| 1,007,184 | 5/1952 | France | 425/59 |
| 623,264 | 12/1935 | Germany | 425/59 |

*Primary Examiner*—Dennis L. Taylor
*Attorney, Agent, or Firm*—Wells, St. John & Roberts

[57] ABSTRACT

A slipform and method for forming a concrete lining in upright open shafts having been previously filled with a liquid such as drilling mud. The drilling mud below the slipform apparatus is pressurized to push the slipform upwardly within the shaft while it simultaneously forms delivered concrete into a monolithic lining within the shaft. The apparatus includes outer and inner slipform members. The inner slipform member fits within a conical recess of the outer slipform member and includes a lower cylindrical portion for forming the open inside diameter of the lining. Concrete, in a plastic, wet condition, is pumped between the two slipform members to be molded against the shaft wall into an upwardly open monolithic concrete lining. The rate of ascent of the forms is timed in accordance with the setting time of the concrete so that the upwardly moving form leaves a hardened monolithic lining behind. The lining is formed in place in the liquid filled shaft while the liquid (drilling mud) is pumped from above the slipform members to the area below. A hydraulic seal is maintained between the slipform members and the shaft walls. The seal is movable with the slipform members as they move upwardly along the shaft walls. A flotation mechanism is provided in the form of inflatable bladders within the form members to selectively render the form members buoyant.

15 Claims, 6 Drawing Figures

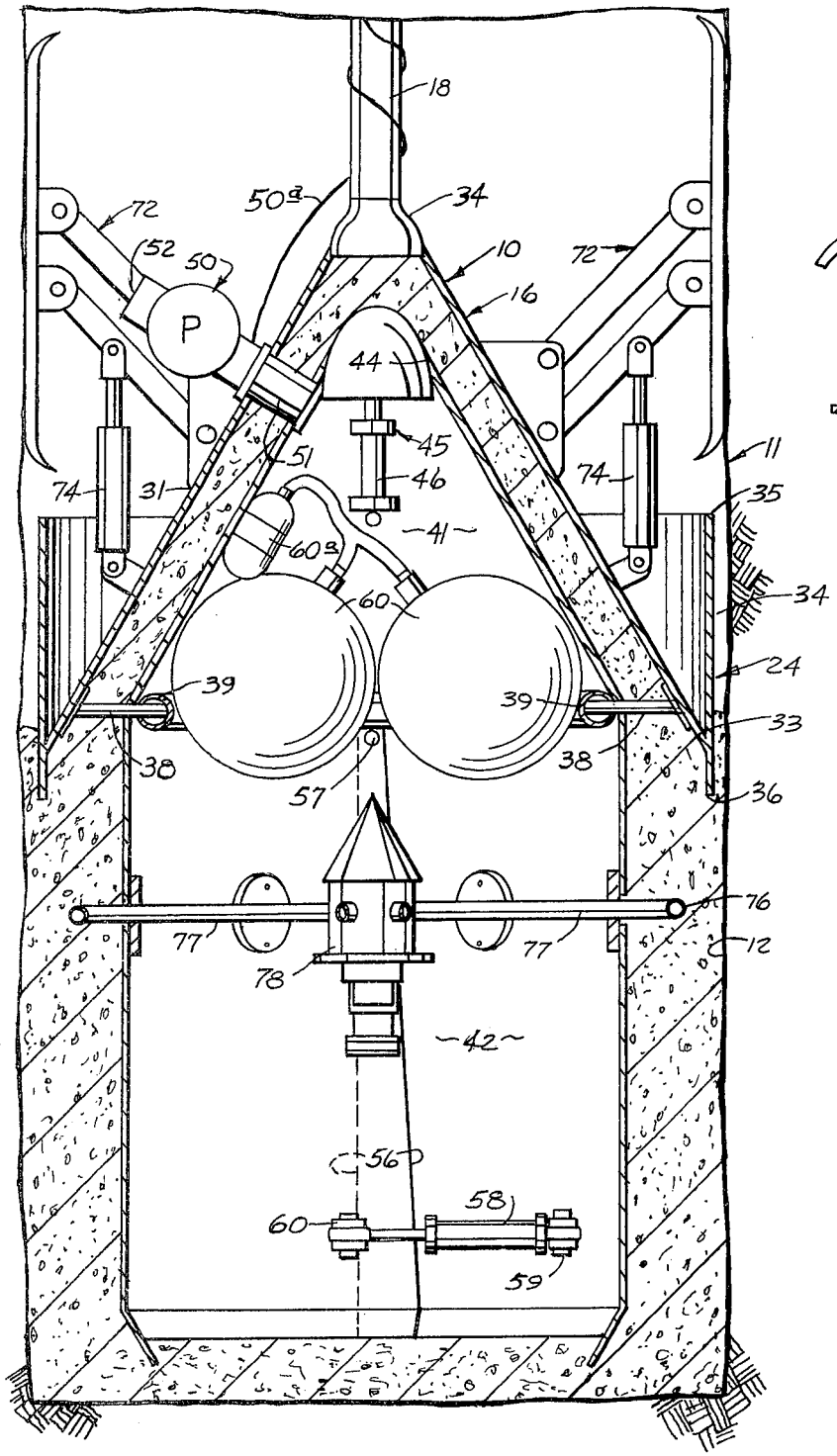
FIG. 3
FIG. 2
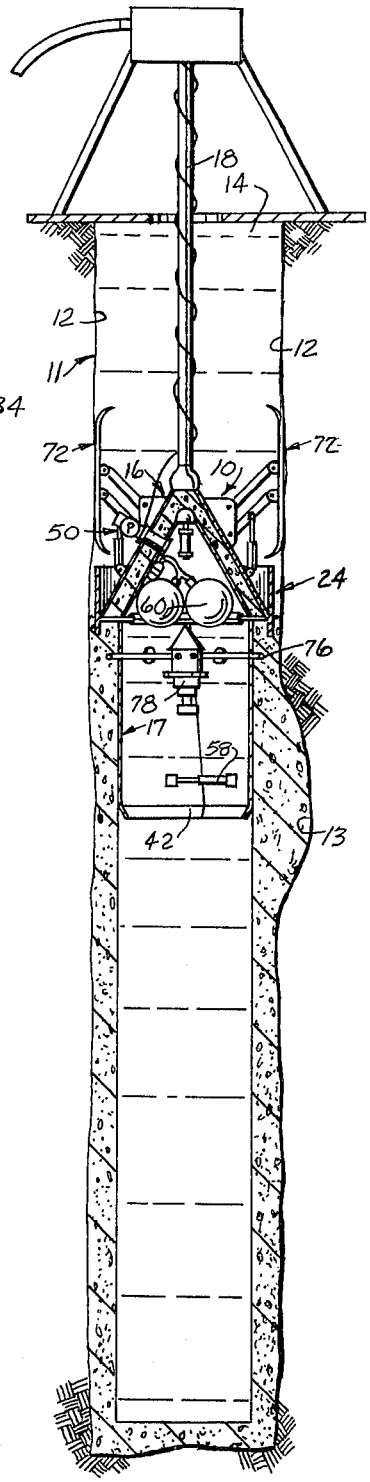

SLIPFORMING METHOD AND APPARATUS FOR IN SITU LINING OF AN UPWARDLY OPEN SHAFT WITH MONOLITHIC CONCRETE

BACKGROUND OF THE INVENTION

The present invention is related to shaft lining forming methods and apparatus and particularly to such methods and apparatus for forming vertical or upright monolithic concrete lining in situ within mine shafts or similar excavations.

In mining operations, central mine shafts, winding shafts, blind shafts, and ventilation shafts are vertical and lead downwardly and beyond horizontal tunnels. Such shafts may extend from the earth surface vertically downward to adjoining tunnels, or they may extend from one tunnel vertically to another tunnel at a different elevation. Futher, vertical shafts, termed "blind shafts," extend downwardly from one tunnel to a closed bottom end. For mining purposes, nearly all vertical shafts must be lined with concrete or masonry to prevent the shaft walls from collapsing or "sloughing" and isolating the adjoining tunnels. During the drilling operation of such upright shafts, a liquid "drilling mud" is utilized to assist the drilling operation and to prevent the shaft walls from sloughing onto the boring head. Ordinarily, the shaft is nearly completely filled with such drilling mud and must be pumped dry before conventional lining operations can take place.

Various apparatus and methods have been produced for placing shaft linings in upright dry excavations. Most presently used apparatus and methods deal with the application of monolithic concrete lining rather than the application of masonry block or brickwork lining.

U.S. Pat. No. 411,981 granted to W. Davis discloses a method of cementing cisterns or wells. The disclosed process must be performed during the excavation process since the bottom of the shaft is utilized to support a retractable cylindrical form. The excavation is taken to a prescribed depth, then a form is laid in place at the bottom of the excavation. Concrete or cement is then poured about the form and allowed to harden between the form walls and shaft. Once the cement has hardened, the form is removed and the excavation is continued on downwardly past the ring of concrete previously formed. It is intended that this ring be utilized as both a portion of the shaft lining and as a "curbing" to hold the shaft walls intact during the remainder of the excavation operation. It is not disclosed how the shaft walls are lined between the cement rings or curbing.

U.S. Pat. No 233,826, granted to W. Wilson on Oct. 26, 1880, discloses an apparatus for lining wells. This device is comprised of two independent form members, one for defining an exterior lining surface, and the remaining form for producing the lining interior surface. In operation, after the shaft has been excavated to a required depth, a section of cement tube is placed within the shaft and pressed against the bottom shaft end. This tube must have inside and outside diameters equal to the corresponding dimensions of the lining. Once this tube has been placed within the bottom of the shaft, the inside or core cylinder is loweed into the tube with a portion of its length extending above the top tube end. The outer cylinder is also put in place about the outside of the tube and also extends upwardly above the upper tube edge. A tubular receptacle is thereby formed into which cement or concrete may be poured and allowed to harden. Once this cement or concrete has hardened, the two form members may be slipped upwardly over the newly formed lining section to form the next successive batch of concrete poured on top of the previously poured section. In this manner, the well lining is produced in a succession of independent pours from the shaft bottom to the top.

The "inchworm" movement of the form members is commonly known as "jump forming" and is expecially used in current shaft lining operations. This process has been reasonably effective. However, this procedure necessitates that the shaft be dry and drilled oversize in order to accommodate the outside form member and further requires that workers be sent down the shaft in order to effectively operate the form members and spread the concrete evenly about the lining between the members. An additional problem with jump forming, since it involves peak labor periods, is relatively low production rates.

U.S. Pat. No 1,313,013 granted to C. Polysu on Aug. 12, 1919 discloses a method and apparatus for casing wells. This apparatus is similar to the Davis device in that the lining is formed in a downward direction from the top of the shaft and is formed while the shaft is being excavated. This particular device utilizes a boring head with a concrete slipform following behind. The lining may be poured after the boring instrument has excavated a shaft to a depth equal to the height of the form members. The slipform itself is simply an inner core member that forms the inside bore of the lining. Concrete is pumped downwardly to the slipform and outwardly into the area between the slipform and boring head.

As the shaft is excavated, the boring head moves downwardly and so does the slipform. Concrete is pumped into the area between the slipform and shaft as the slipform moves downwardly at a rate supposedly equal to the rate of excavation of the boring head. This rate is controlled to correspond to the setting time for the concrete so that the form lining supports itself within the shaft after disengagement from the inner core member.

At the end of the boring operation, the slipform must be left within the shaft, since the full weight of the shaft lining rests upon the lower portion thereof. The setting time of the concrete being delivered to the slipform must be timed precisely with the advancement of the boring tool. Therefore, the conditions of the soil surrounding the shaft area must be very carefully considered and extremely prompt action must be taken once soil conditions change. Otherwise, the lining is not formed at a correct rate. For example, if the lining were formed too quickly, the concrete could possibly not harden and could therefore fall apart once the slipform moved downwardly leaving the wet concrete to support itself. Should the boring head move to slowly, the concrete could harden within the delivery tube and halt progression of the lining at that point.

U.S. Pat. No. 3,827,244, granted to H. L. Walbrö on Aug. 6, 1974, discloses a form for producing concrete linings in mine galleries, tunnels, shafts, or the like. A slipform is used by Walbrö and is pulled directly behind a tunnelling cutter. It includes a relatively short forming member that receives and forms concrete about its periphery against the tunnel walls and a series of thrust members that are utilized to support the "green" concrete until it reaches a sufficiently stable form to support itself and withstand the pressure exerted by the earth around the tunnel. The thrust members are pulled along with the forming head at a rate such that the last thrust member leaves the concrete lining surface exposed as that surface reaches a hardened condition. It is the "shutters" or reinforcing rib members that are the central subject of this patent, not the specific details of a slipform. The slipform itself is pulled along as it receives concrete in a wet state by a boring mechanism.

Other patents of general interest are U.S. Pat. No 3,270,511 granted on Sept. 6, 1966 to E. Colly and U.S. Pat. No. 3,768,267 Oct. 19, 1973 to N. Chlumecky. Also, further background material may be found by referring to my U.S. Pat. No. 3,877,855 granted Apr. 15, 1975.

The present invention relates to a method and apparatus whereby a freshly bored shaft having been previously filled with a liquid such as drilling mud may be lined in situ with concrete in a relatively continuous monolithic form by delivering wet concrete to two longitudinally spaced form members within the upright shaft and pumping the drilling mud from above the form members to the area below the form members to pressurize that area and thereby force the form members upwardly within the shaft as the concrete is received thereby. An outer form member of the two is sealed to the shaft wall through a movable hydraulic seal formed by the wet concrete. The inner core member is utilized simply to form the concrete about the shaft walls and define an inside bore of the finished lining. Wet concrete is delivered to the two form members through an elongated tube at a rate complementary to the rate of ascent for the two form members. This rate is timed in accordance to the setting time of the concrete such that the inside form member will leave the lining walls in a hardened, self-supporting state as it becomes disengaged therewith. No frictional engagement of any lining or shaft wall surfaces is required to perform the function of moving or lifting the slipform upwardly as concrete is simultaneously delivered to produce the formed monolithic lining.

SUMMARY OF THE INVENTION

A slipform apparatus and method is described for lining an upwardly open vertical walled shaft filled with a liquid such as drilling mud. The apparatus includes an outer form member and a downwardly spaced inner core member. The outer form member is downwardly open and includes a lower peripheral edge that is complementary in configuration to the shaft cross section. The inner core member is mounted to the outer form member and spaced inwardly therefrom. It includes an upright core wall that is parallel to and spaced inwardly from the shaft wall. The core wall forms the inside wall of the lining. Also included is means for delivering concrete in a plastic state between the outer and inner form members to fill the gap between the shaft and core wall. A seal means is provided on the outer form member for providing a movable hydraulic seal between the outer form member and shaft wall. Pump means is included for pumping the liquid within the shaft from an area above the outer form member to pressurize the area within the shaft below the inner core member. This produces a reaction force against the form members to move them upwardly within the shaft as the concrete is simultaneously received and formed against the shaft wall. The present method includes the steps of:

1. lowering a slipform as described above downwardly into an upwardly open shaft having been previously filled with a liquid drilling mud;
2. forming a movable hydraulic seal between the outer form member and shaft wall;
3. delivering concrete in a plastic state between the form members and shaft wall;
4. pumping liquid from above the slipform members to the area below the slipform members to thereby pressurize the area within the shaft below the slipform members and force the members upwardly within the shaft; and
5. forming the concrete received by the slipform into an open lining against the shaft walls as the slipform moves.

It is a primary object of the present invention to provide a concrete slipform apparatus and method for the purpose of in situ forming a monolithic concrete lining in freshly bored upright shafts that are filled with a liquid such as drilling mud.

Another object is to provide such an apparatus that will move upwardly within an upright shaft at a rate corresponding to the rate that concrete is received between the forming members to thereby present little problem in the area of full control and rate of ascent for the form members.

A still further object is to provide such an apparatus and method that requires substantially fewer drive and control mechanisms than prior apparatus and is thereby relatively more economical to utilize than previous lining mechanisms and methods.

A still further object is to provide a shaft lining apparatus that provides a hydraulic seal between an outer forming member and the shaft walls to thereby present relatively friction free engagement of the lining members with the shaft wall surfaces.

A still further object is to provide such an apparatus and method that produces forces directly against the forming members from below to provide a more accurate and controlled system by which the form members may be moved upwardly within the shaft in response to reception of wet concrete thereby.

These and still further objects and advantages will become apparent upon reading the following detailed description which, taken with the accompanying drawings, disclose a preferred form of my invention. It should be noted that the following description is not intended to place restrictions upon my invention and that only the claims found at the end of this specification are to be taken as limitations of my invention.

BRIEF DESCRIPTION OF THE DRAWINGS

FIG. 2 is an enlarged sectional view showing the invention in operation;

FIG. 3 is an enlarged sectional view showing the forming elements and pumping means;

DETAILED DESCRIPTION OF A PREFERRED EMBODIMENT

Figure 1:
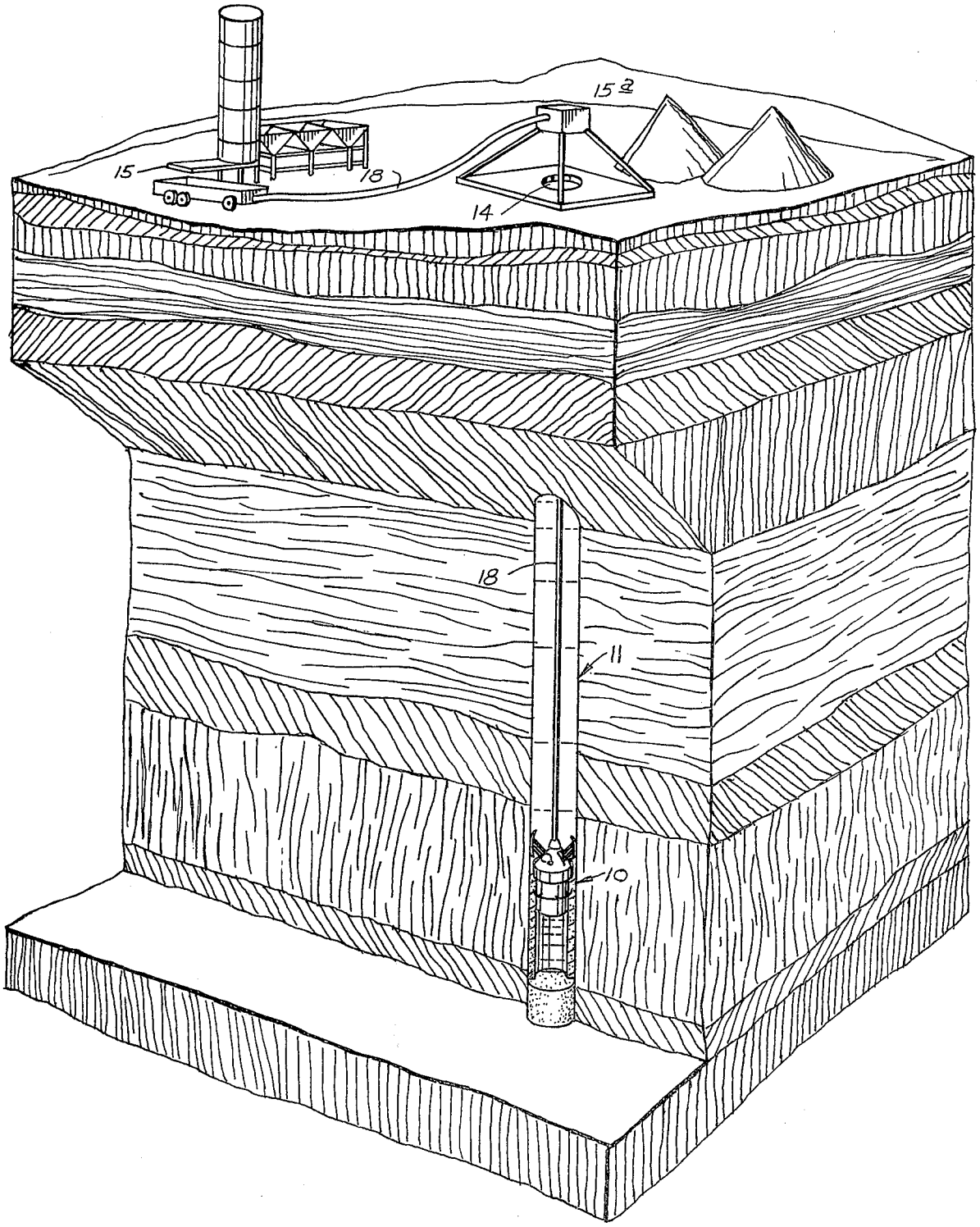
FIG. 1 is a pictorial schematic view showing the present operation of forming a lining within a ventilation shaft.
Figure 5:
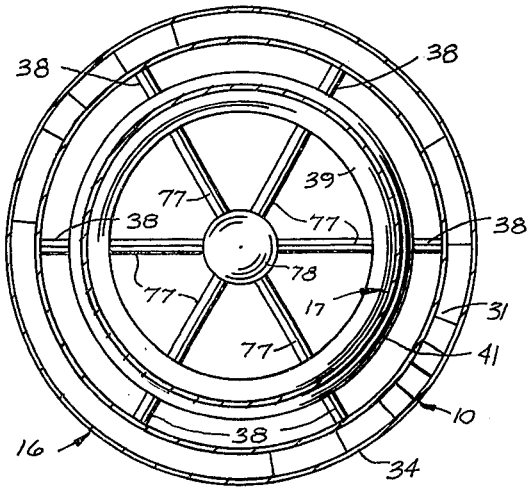
FIG. 5 is a sectional view taken along line 5—5 in FIG. 4.

The apparatus of the present invention is illustrated in the accompanying drawings and is generally designated therein by the reference character 10. It is intended that the present slipform mechanisn 10 be utilized within upright shafts such as that shown at 11 in FIG. 1. It is preferred that the shaft include vertical walls 12 of continuous cross-sectional configuration along the shaft length. However, such shafts may have occasional irregularities or areas where the walls have sloughed off during the boring operation. Such an area is shown at 13 in FIGS. 1 and 2.

It is necessary for the present invention that the shaft 11 be filled with a watery fluid, normally drilling mud. This fluid is utilized during the boring operation to support the shaft walls during and after the drilling operation. It is ordinarily pumped clear of the shaft after the boring procedure has been completed. However, as will be understood from the following disclosure, it is essential, with the present invention, that the liquid drilling mud remain within the shaft during the present lining forming operation. The mud is utilized during the forming operation both as support for the shaft walls and as a pressure medium for driving the slipform upwardly in the shaft during the lining operation.

The present slipform 10 is operated from an upper open end 14 of shaft 11. A concrete supply source 15 is shown in FIG. 1 adjacent to a control derrick 15*a*. The concrete supply source 15 provides a continuous supply of wet concrete to the slipform when in operation.

The slipform includes an outer form member 16 and an inner core form member 17. An elongated delivery pipe 18 is connected to member 16 for directing concrete from the supply source 15 to the members 16 and 17. It is not essential that the delivery pipe be rigid. It is used merely to deliver concrete to the form members 16 and 17 and to support the form members as they are lowered to the shaft bottom.

Figure 6:
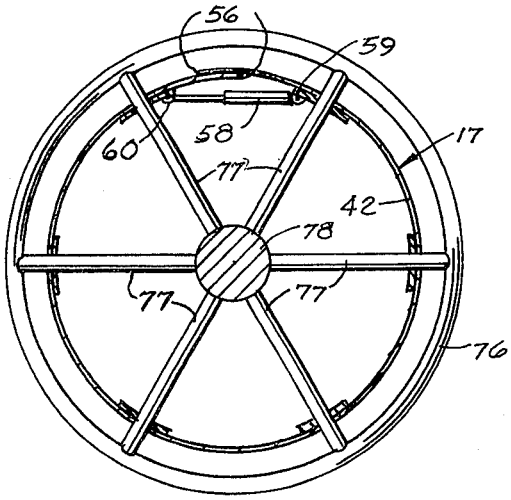
FIG. 6 is a view taken along line 6—6 in FIG. 5.

The outer form member 16 is shown in substantial detail in FIGS. 3 and 6. As shown, the outer form member is substantially conical in configuration. It includes a continuous conical wall surface 31 that extends from a reduced upper end 32 to a lower peripheral edge 33. Lower edge 33 is substantially complementary to the cross-sectional configuration of shaft 11 (substantially cylindrical). The upper end 32 is connected directly to the supply tube 18 at a connector joint 34.

The conical outer member 16 serves to direct concrete from the delivery tube 18 outwardly toward the shaft walls. The edge 33 is spaced slightly inward of the shaft walls and includes a hydraulic seal means 24 between the slipform and shaft wall.

A seal means 24 is provided at the peripheral edge 33 of outer member 16. It is located between the outer form member 16 and shaft 11 and is basically comprised of an upright cylindrical wall 34. Wall 34 is an integral portion of the outer form member 16. Wall 34 is continuous about form number 16 and is parallel along its length (the length dimension being with reference to the length dimension of shaft 11) to the shaft wall 12. The cross-sectional dimension of cylindrical wall 34 is somewhat less than the same dimension of shaft 11. Therefore, the wall 34 is spaced slightly inwardly adjacent to the shaft walls 12.

The cylindrical wall 34 includes an upper edge 35 and a lower edge 36. Concrete may enter between the surface of walls 34 and 12. However, wall 34 is spaced adjacent to the complementary shaft wall 12 so that upward concrete flow is severely restricted. Because of this restriction, the concrete will not overflow the upper wall edge 35 unless excessive pressure is applied through the deliver tube 18. If the concrete supply pump connected to the delivery tube is regulated to maintain a prescribed flow of concrete, a movable hydraulic seal may be maintained between wall 34 and shaft walls 12 simply by raising the form members at a corresponding rate. With the hydraulic seal provided through means 24, the slipform is capable of "floating" on the concrete delivered thereto without frictional engagement between the form members and shaft wall.

The inner core member 17 is mounted to outer form member 16 by a number of radial brace members 38. These members 38 extend between member 17 and outer member 16. A circular base ring 39 is provided to rigidly connect the brace members and more securely mount the core member 17 to the outer form member 16.

The inner core member 17 includes an upper conical member 41 that is complementary to and spaced inwardly of the conical wall surface 31 of outer member 16. The inner conical member 41 is joined at a lower edge thereof to a lower cylindrical member 42. It is the cylindrical member 42 that defines the inside cross-sectional configuration of the concrete lining.

A feature of the present apparatus is the construction of cylindrical wall section 42 and its function in relation to the present method and apparatus. The cylindrical member 42 extends along an axis that is coaxial to the upright center line of shaft 11. The cylinder is constructed of a single sheet of material having longitudinal side edges 56 (FIG. 3) that overlap one another. Edges 56 are joined together at an upper end by a pivot pin 57. A hydraulic ram cylinder 58 connects the overlapping edges adjacent the open lower end of member 42. A bracket 59 mounts one end of the ram 58 to one side of the overlapping joint while a bracket 60 mounts the remaining end of ram 58 to the cylinder 42 on an opposite side of the joint. Ram 58 may be selectively operated to extend or retract and thereby expand or contract the effective cross-sectional diameter of the member 42 at its lower end.

Contraction of the ram 58 results in corresponding contraction of the cylinder member 42 to facilitate disengagement of the cylinder 42 with the concrete lining. Thus, if concrete around the cylindrical portion 42 were to prematurely harden, the ram 58 could be contracted to disengage the surface from the lining and allow the slipform to be lifted from engagement with the hardened lining.

An upper opening member 41 includes a dump plug assembly 45. The assembly 45 includes a cylinder 46 attached to a bullet shaped plug that fits within opening 44. The cylinder 46 may be selectively operated to lower the plug from engagement with the opening and thereby allow concrete to fall into the central opening area without being passed between the form members to become part of the lining 19. The plug assembly is provided as a precaution to enable evacuation of undesirable material sent through the delivery tube 18 rather than delivering such material between the form and core members to become an integral part of the lining.

Figure 4:
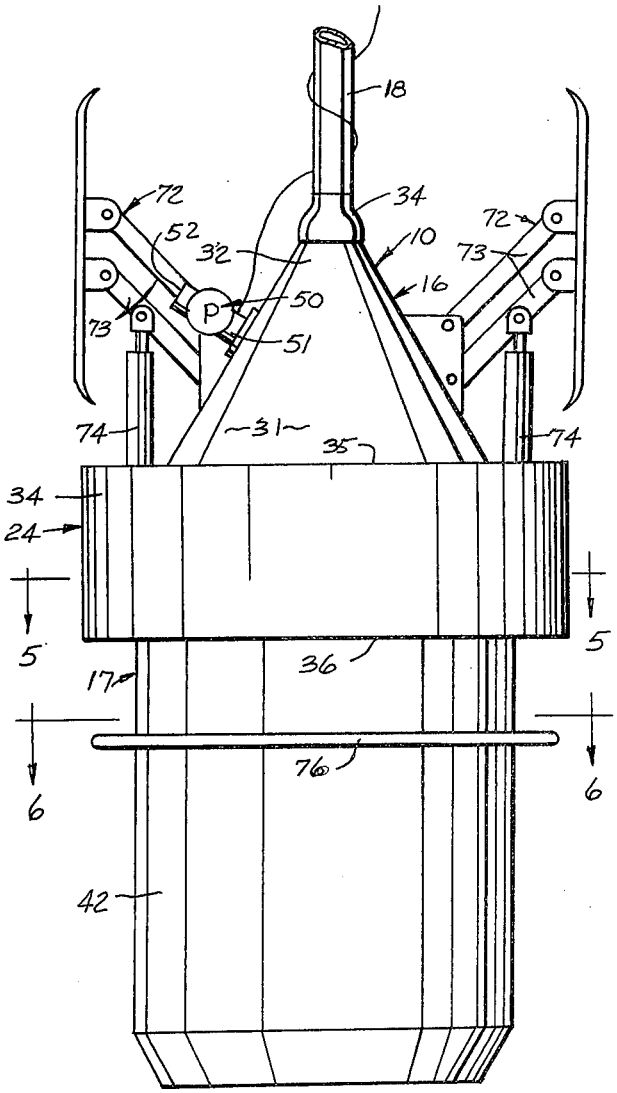
FIG. 4 is an elevational view of the forming elements.

A very important feature of the present invention is a provision of a pump means illustrated at 50 in FIGS. 3 and 4. Pump means 50 is connected to a vent tube 51 that openly communicates with the area below the inner form member 17. The pump receives the drilling mud through an intake 52 and forcibly moves it through the tube 51 to the area below the slipform member 17. This pressurizes the area below the form members to produce a reaction force against the form members that thereby causes upward movement of the form members within the shaft.

The flow rate of the pump is variable and controlled from above ground through a control line 50*a*. Other lines including hydraulic and/or electrical lines (not shown) may also extend upwardly from the form members. Through selective operation, the pump may be controlled to selectively control the ascent of the form members in order to allow sufficient time for the concrete received between the members to dry to a self-supporting state before it leaves engagement with the inner core member 17.

Another provision is the inclusion of a floatation means in the form of inflatable bladders 60. Bladders 60 are shown inflated but are normally deflated. They are connected to a source of air pressure, bottle 60*a*, that may be selectively operated to inflate the bladders and impart buoyancy to the slipform members to assist upward movement of the form members when submerged in the drilling mud. The bladders may be utilized to assist ascent of the form members should a breakdown occur in the pump assembly 50 or in a situation wherein the pump assembly becomes ineffective.

When concrete is being delivered between the form members 16 and 17, it has been found that the brace members 38 will segregate aggregate from the wet cement mixture and thereby leave vertical lines in the finished lining that will crack under excessive stress. To prevent this separation, a vibration means is located directly downstream of the braces at a position where the concrete is still in a relatively plastic state during the forming process. The vibration means includes a circular ring 76 that encircles the area between core member 17 and the shaft wall. Vibration is imparted to ring 76 through radial spokes 77. The spokes 77, in turn, are operatively connected to a central vibration motor 78. The ring will vibrate at a fixed frequency in response to motor 78. As the slipform moves upwardly, the vibrating ring will move through the wet concrete, consolidating the aggregate and liquifying the wet concrete so it will mold itself intimately agains the shaft wall.

Ordinarily, no reinforcement is utilized in conjunction with monolithic linings formed by a slipform. However, recently developed reinforceing fibers (either glass or metal) may be pumped along with the concrete to provide structural reinforcement to the finished lining. The inclusion of such reinforcing fibers will not adversely effect operation of the vibrator mechanism or lining forming operation.

Upward movement of the slipform within shaft 11 is guided through means of a set of ski members 72. The ski members 72 are pivotably mounted to the outer form members 16 through parallelogram type linkages 73. Each member 72 is also connected to the outer form members 16 by a selectively operably cylinder 74. Thus, the skis may be pivoted to engagement with the shaft walls 12 in order to center the slipform within the shaft opening and hold it in that centered position while it is moved upwardly. The skis may be disengaged from the shaft wall and held radially inward of the walls 12 to permit free movement of the slipform downwardly into the shaft.

Each cylinder 74 may be operated independently through conventional valve controls to selectively vary the position of the slipform within the shaft 11. Thus, some variation in the shaft such as the slough area 13 (shown in FIG. 2) may be accommodated by independently controlling the cylinders 74 to maintain the slipform within the shaft center.

The sloughed areas 13 that are occasionally encountered during the drilling operation, even though drilling mud is utilized to hold such occurrences at a minimum, present a slight problem that may be easily overcome through use of the present method and apparatus. As the form members are moving upwardly within the shaft, and such a sloughed area is encountered, the rate of ascent for the members may be slowed by decreasing the flow rate of the pump means in order that the sloughed area may be filled completely by wet concrete. Another alternative is to pump the concrete downwardly through supply tube 18 at an increased rate once the sloughed area is encountered. In this instance, the upward rate of the slipform would remain at the previously set rate of ascent. Once the sloughed area has filled in with concrete, the flow rate of concrete may be again returned to the normal rate of flow, or the previous rate of ascent of the slipform members may be again assumed.

From the above technical disclosure, the present method for lining upright liquid filled shafts with monolithic concrete may be now understood.

After the initial boring operation in which the shaft is formed and filled with a liquid drilling mud, the present method is initiated by gradually lowering the slipform members 16 and 17 downwardly into the shaft by the concrete delivery tube 18. Once the slipform members have reached the bottom of the shaft, the concrete supply means is actuated and a "rabbit" or slidable plug is placed in the delivery tube to move ahead of concrete being pumped downwardly through the tube to the form members.

The rabbit will evacuate the delivery tube completely of drilling mud but cannot be made to facilitate evacuation of the entire area between members 16 and 17, nor the area between cylindrical wall 42 and the shaft walls 12. Therefore, the pump means is not operated to initiate upward movement of the slipform until sufficient time has passed for the pumped concrete to completely evacuate the lining area of drilling mud. This is done simply by utilizing the concrete itself as the rabbit to push the drilling mud downwardly and into the central portion of the cylindrical wall section 42. This allows a slight buildup of concrete along the bottom of the shaft which may be later removed or utilized as a sump for the shaft.

Once it becomes reasonable to assume that the concrete has completely displaced the drilling mud from the lining area, the pump means may be actuated to initiate the process of removing drilling mud from the area above the form members and pumping it through the vent tube 51 into the area below the form members. This causes a higher pressure area below the form members than exists above the form members. The result is that the pressurized mud acts against the form members and pushes them upwardly within the shaft at a selected rate. Prior to this, as the concrete is initially received between the form members and shaft walls 12, a slight buildup of concrete between the cylindrical wall section 34 and shaft walls 12 serves to form the movable hydraulic seal that will be maintained throughout the continuous forming operation.

The rate of ascent for the slipform members is determined by controlling the flow rate of the pump means to lift the form members and delivery tube at a rate in correspondence to the rate of delivery of concrete to the form members. This rate is also associated with the setting time of the concrete so that once the cylindrical wall portion 42 leaves engagement with the lining, the concrete at that level has attained a "set condition" wherein it is self-supporting. The drilling mud greatly assists the present method by providing support the not yet fully hardened walls of the lining while the slipform is moved upwardly.

If the members encounter a sloughed area 13, the rate of ascent is slowed or more concrete is delivered in order that the area be completely filled with concrete while the slipform moves upwardly along a vertical shaft axis. Usually the sloughed areas are known at the time of drilling and can be accounted for by detecting the elevation of the slough area and metering ascent of the slipform. Additionally, there may be sensor mechanisms (not shown) provided on the outer form member or guide skis to detect or indicate the distance from the shaft center to the shaft walls. If this distance is substantially increased, an automatic control (also not shown) could be actuated to correspondingly slow the flow rate through the pump means or to increase the concrete flow until the sloughed are is filled in. The guide skis serve to maintain the form members centered within the shaft during the procedure of filling the sloughed area.

Upward movement of the form members may be entirely continuous providing breakdowns do not occur. Even so, breakdowns do occur and provisions have been made to prevent the form members from being anchored to the lining should such a breakdown occur wherein the pump means would not be useful in moving the forms upwardly out of engagement with the concrete lining. Should a breakdown occur when the forming members 16 and 17 would necessarily be held stationary for a long period of time, there are provisions in the cylinder 58 and overlapping sides of cylindrical section 42 to allow disengagement of the slipform with the lining.

For example, if the concrete supply mechanism sustained a breakdown, the slipform would likely sit stationary for a relatively extended period of time. To prevent the form from being anchored by the setting concrete, the cylinder 58 could be retracted to reduce the outside diameter of the cylindrical wall 42 and enable disengagement of the slipform from the shaft lining. In such a situation it is possible that the pump means would not be entirely functional (because of the broken hydraulic seal previously afforded by means 24) to move the slipform upwardly away from engagement with the lining. In this instance, the bladders may be inflated to impart buoyancy to the form members in order to float the members upwardly from engagement with the lining.

Once the lining process has been stopped for a period of time, it becomes necessary to again flush the drilling mud from the delivery tube and areas between members 16 and 17 in order to restart the lining with a fresh, solid joint between the hardened previously formed lining and the new continuation thereof. To accomplish this, the form is lowered to the top end of the hardened lining and another rabbit is sent through the delivery tube. The mud may be discharged through the dump plug arrangement 45. The pumped concrete is then utilized as previously described to evacuate the lining area of drilling mud. The concrete is pumped for a period of time sufficient to flush the delivery area completely of the drilling mud. If it is not entirely possible to flush the mud from the area and leave a solid joint, a weakened area will result at the juncture of the old lining with the new. This area may be easily repaired once the lining has been completed and the drilling mud pumped from the shaft core.

The lining operation is completed as the slipform members reach the top of the shaft 14.

It may have become obvious that various changes and modifications may be made in the apparatus and method disclosed in the foregoing description. It was intended, however, that this description only set forth an example of a preferred form of my invention. Only the following claims are to be taken as restrictions upon the invention.

What I claim is:

1. A slipform for forming a monolithic concrete lining in an upwardly open vertical walled shaft filled with a liquid such as drilling mud, comprising:

an outer downwardly open form member having a lower peripheral edge of complementary configuration to the shaft cross section;

an upwardly closed inner core form member mounted to the outer form member and spaced inwardly therefrom;

an upright core wall parallel to and spaced inwardly from the shaft wall for forming the inside wall of the lining;

means for delivering concrete in a plastic state between the outer and inner form members to fill the gap between the shaft wall and core wall;

seal means on the outer form for providing a movable hydraulic seal between the outer form member and shaft wall; and pump means for pumping liquid within the shaft from above the outer form member to pressurize the area within the shaft below the inner core member and thereby force the form members upwardly within the shaft as concrete is simultaneously received and formed against the shaft wall.

2. The slipform as defined by claim 1 wherein the shaft is circular in cross section and wherein the form members are complementary in cross section to the shaft with the first outer form member having a conical wall surface tapering from a lower circular edge adjacent the shaft wall, upwardly to a reduced concrete inlet port end wherein the inner core form member includes an inner conical surface inwardly adjacent and parallel to the outer conical surface and wherein the upright core wall is cylindrical and joined to a lower peripheral edge of the inner conical surface.

3. The slipform as defined by claim 2 wherein the upright core wall is formed of a single sheet of material with overlapping longitudinal edges and wherein means is includes for moving the longitudinal edges in opposite lateral directions to selectively change the core wall diameter.

4. The slipform assembly as recited by claim 1 further comprising flotation means within the confines of the inner core form member selectively inflatable to render the slipform assembly buoyant within the shaft.

5. the slipform assembly as recited by claim 1 wherein the pump means includes a variable flow fluid pump operatively connected to a duct extending through the form members and openly communicating with the area within the shaft below the inner core form member, said pump having an intake openly communicating with the area within the shaft above the outer form member.

6. The slipform assembly as defined by claim 1 wherein the seal means is comprised of a cylindrical wall extending about the outer core member with an outward surface directly adjacent and parallel to the shaft wall.

7. The slipform assembly as defined by claim 1 further including retractable guide means selectively engageable with the shaft wall for centering the form members in the shaft.

8. The slipform assembly as defined by claim 1 further comprising a concrete dump valve means on the core form member for dumping concrete directly from the area between the outer form member and inner core member to the area enclosed by the upright core wall.

9. The slipform assembly as defined by claim 1 further comprising vibrator means encircling the core wall between the inner core and outer form member.

10. A method for forming a monolithic concrete lining in a vertical upwardly open shaft having been previously filled with a liquid such as drilling mud, comprising the steps of:

lowering a slipform having an outer form member complementary to the cross-sectional shaft configuration and an inwardly spaced core form member into the shaft;

forming a movable hydraulic seal between the outer form and shaft wall;

pumping concrete in a plastic state between the form members and shaft wall;

pumping the liquid from above the slipform to the area below the slipform to pressurize the area within the shaft below the slipform and thereby force the slipform upwardly within the shaft;

forming the concrete received by the slipform into an open lining against the shaft walls as the slipform moves upwardly.

11. The method as recited by claim 10 further including the step of inflating a flotation means within the slipform to selectively render the slipform buoyant.

12. The method set out by claim 10 wherein the step of forming a movable hydraulic seal is accomplished by:

locating an upright wall of the outer form member directly adjacent to the shaft wall, said wall being parallel to the shaft wall and affixed to the outer form member.

13. The method set out by claim 10 further comprising the step of vibrating the concrete as it is formed against the shaft wall.

14. The method set out by claim 10 comprising the further step of: centering the slipform within the shaft so the lining formed thereby will be of uniform thickness.

15. The method set out by claim 10 comprising the further step of selectively disengaging the core form member from the lining by contracting the form to a cross-sectional dimension less than the complementary cross-sectional dimension of the lining.

* * * * *